US008932088B2

(12) United States Patent
Lalancette et al.

(10) Patent No.: US 8,932,088 B2
(45) Date of Patent: Jan. 13, 2015

(54) ANTI-TURN MECHANISM FOR MULTIPLE CONNECTOR SIZES

(71) Applicant: Thomas & Betts International, Inc., Wilmington, DE (US)

(72) Inventors: Daniel Lalancette, St-Jean-sur-Richelieu (CA); Yves Boucher, St-Jean-sur-Richelieu (CA)

(73) Assignee: Thomas & Betts International, Inc., Wilmington, DE (US)

( * ) Notice: Subject to any disclaimer, the term of this patent is extended or adjusted under 35 U.S.C. 154(b) by 74 days.

(21) Appl. No.: 13/785,246

(22) Filed: Mar. 5, 2013

(65) Prior Publication Data

US 2013/0280967 A1 Oct. 24, 2013

Related U.S. Application Data

(60) Provisional application No. 61/636,776, filed on Apr. 23, 2012.

(51) Int. Cl.
*H01R 4/30* (2006.01)
*H01R 4/38* (2006.01)

(52) U.S. Cl.
CPC ..... *H01R 4/305* (2013.01)
USPC ..... 439/801

(58) Field of Classification Search
CPC ..... H01R 4/305; H01R 4/30; H02B 1/03; H02B 1/04
USPC ..... 439/801
See application file for complete search history.

(56) References Cited

U.S. PATENT DOCUMENTS

| | | | | |
|---|---|---|---|---|
| 3,365,537 | A | | 1/1968 | Fehr, Jr. et al. |
| 3,966,296 | A | | 6/1976 | Ericson |
| 4,369,484 | A | * | 1/1983 | Fugate et al. ..... 361/624 |
| 4,631,634 | A | | 12/1986 | Raabe et al. |
| 4,646,200 | A | | 2/1987 | M'Sadoques et al. |
| 4,679,120 | A | | 7/1987 | Raabe et al. |
| 4,713,728 | A | | 12/1987 | Raabe et al. |
| 4,720,769 | A | | 1/1988 | Raabe et al. |
| 4,783,718 | A | | 11/1988 | Raabe et al. |
| 4,849,581 | A | | 7/1989 | Larkin et al. |
| 4,950,841 | A | | 8/1990 | Walker et al. |
| 5,072,081 | A | | 12/1991 | Sepelak et al. |
| 5,075,659 | A | | 12/1991 | Morgan et al. |
| 5,080,599 | A | | 1/1992 | Wimberly |
| 5,117,211 | A | * | 5/1992 | Morgan et al. ..... 335/202 |
| 5,160,284 | A | | 11/1992 | Krom |
| 5,162,766 | A | | 11/1992 | Morris et al. |

(Continued)

*Primary Examiner* — Javaid Nasri
(74) *Attorney, Agent, or Firm* — Snyder, Clark, Lesch & Chung, LLP

(57) ABSTRACT

A conductive member for mounting a meter socket line connector includes an aperture configured to receive a fastener for the line connector and a protrusion in a different plane than that of the aperture. The protrusion includes a first notch configured to receive a first-size line connector that is secured to the conductive member by the fastener through the aperture and a second notch configured to receive a second-size line connector that is secured to the conductive member by the fastener through the aperture. The protrusion is configured to receive a corner of either the first-size line connector or the second-size line connector without changes to the conductive member.

20 Claims, 10 Drawing Sheets

(56) References Cited

U.S. PATENT DOCUMENTS

| | | | |
|---|---|---|---|
| 5,196,987 | A | 3/1993 | Webber et al. |
| 5,627,724 | A | 5/1997 | Leach et al. |
| 5,716,154 | A | 2/1998 | Miller et al. |
| 5,945,650 | A | 8/1999 | Holland et al. |
| 5,969,308 | A | 10/1999 | Pever |
| 6,061,230 | A | 5/2000 | Mazzella et al. |
| 6,803,146 | B2 | 10/2004 | Key et al. |
| 2013/0279086 | A1 * | 10/2013 | Lalancette et al. ..... 361/662 |

* cited by examiner

ANTI-TURN MECHANISM FOR MULTIPLE CONNECTOR SIZES

RELATED APPLICATION

This application claims priority under 35 U.S.C. §119, based on U.S. Provisional Patent Application No. 61/636,776, filed Apr. 23, 2012, the disclosure of which is hereby incorporated by reference herein.

BACKGROUND INFORMATION

In the electric utility industry, plug-in, socket-type, watt-hour meters are commonly used to measure electric power consumption at residential or commercial sites. The most common type is more properly known as a kilowatt hour meter or a joule meter. When used in electricity retailing, the utilities record the values measured by these meters to generate an invoice for the electricity. These meters may also record other variables including the time when the electricity was used.

The socket for the watt-hour meter is usually installed in a housing that is mounted on a wall of the residence or commercial building. Typically, the housing is transparent or has a window so that the meter can be read without opening the housing. The meter socket contains line and load terminals which are respectively connected to electric line and load connectors. The line and load connectors are connected to cables providing electrical power to/from the meter socket. The terminals receive the blade contacts of a plug-in watt-hour meter to complete an electric circuit through the meter between the line and load terminals.

DETAILED DESCRIPTION OF PREFERRED EMBODIMENTS

The following detailed description refers to the accompanying drawings. The same reference numbers in different drawings may identify the same or similar elements. Also, the following detailed description does not limit the invention.

According to implementations described herein, a conductive member for mounting a meter socket line connector may include an aperture configured to receive a fastener for the line connector and a protrusion located in a different plane than that of the aperture. The protrusion may include a first notch configured to receive a first-size line connector that is secured to the conductive member by the fastener through the aperture and a second notch configured to receive a second-size line connector that is secured to the conductive member by the fastener through the aperture. The protrusion may be configured to receive a corner of either the first-size line connector or the second-size line connector without changes to the conductive member. The first notch and the second notch may each engage two surfaces of a respective first-size or second-size line connector to prevent rotation of the line connectors around the fastener.

Figure 1A:
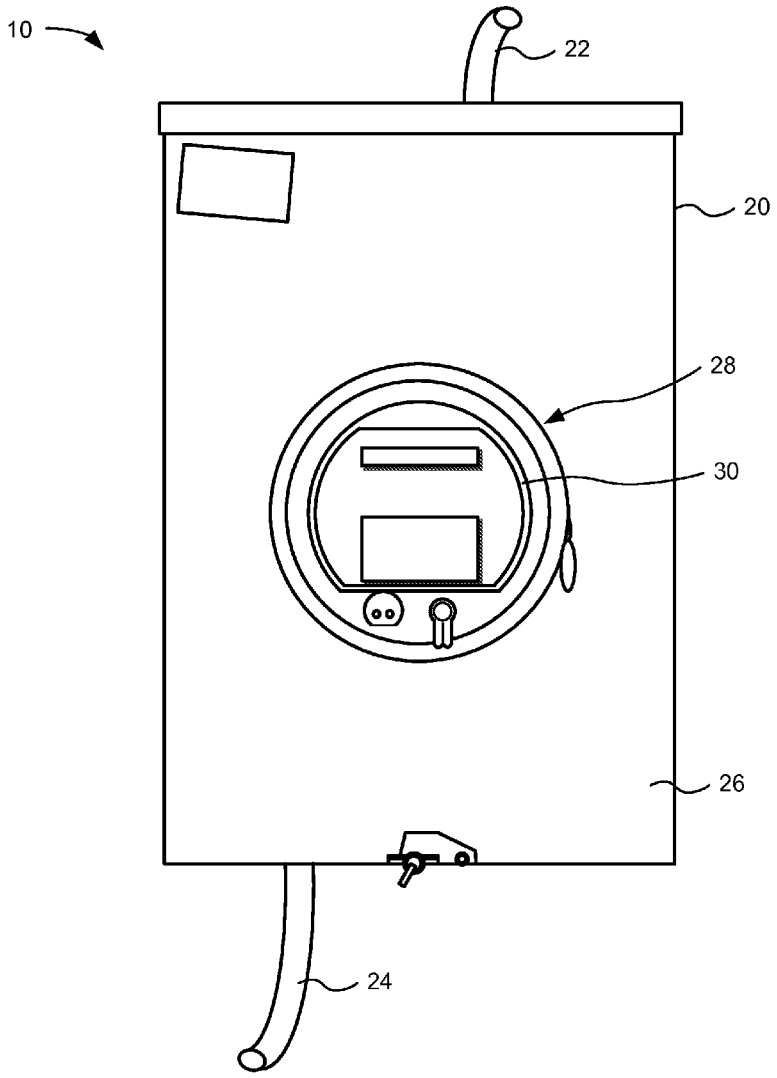
FIGS. 1A and 1B provide views of a watt-hour meter assembly in which systems and/or methods described herein may be implemented.
Figure 1B:
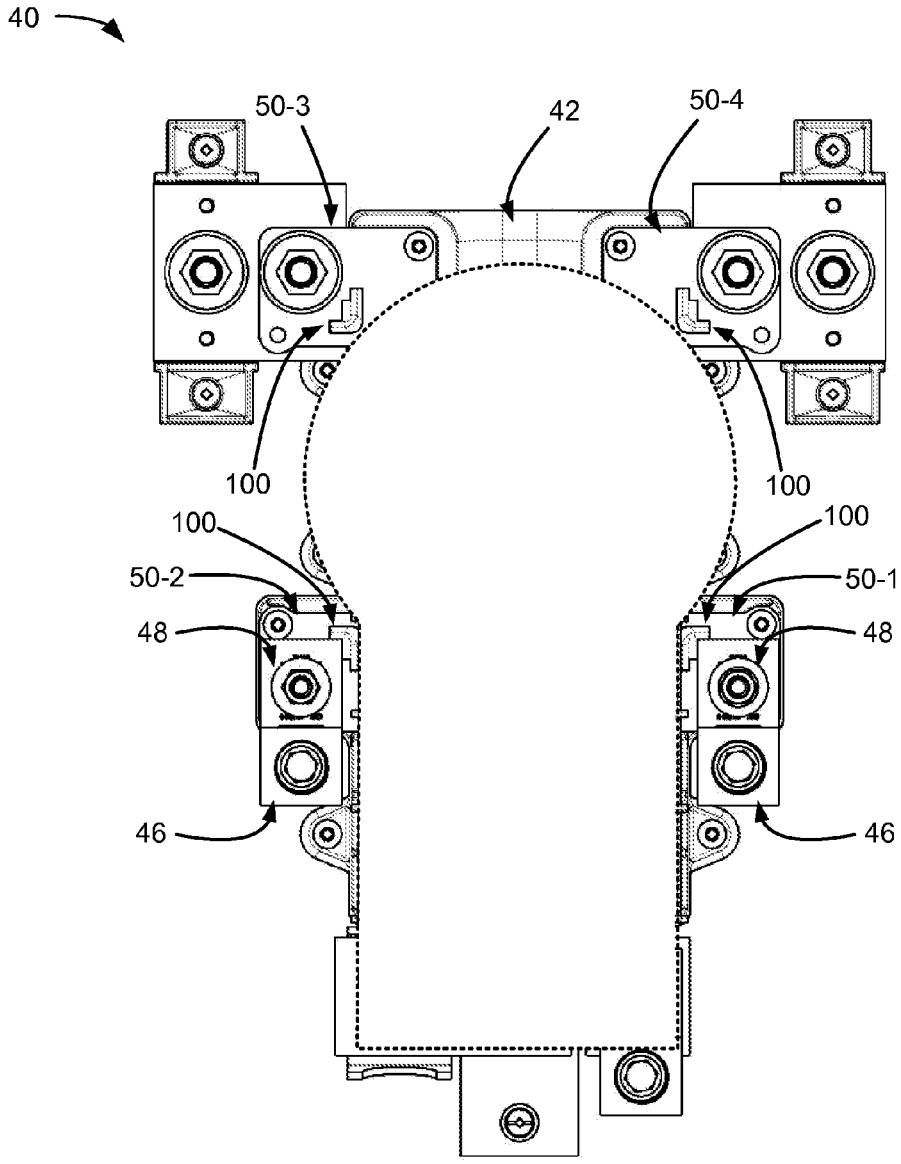

FIGS. 1A and 1B provide views of a watt-hour meter assembly 10 in which systems and/or methods described herein may be implemented. More particularly, FIG. 1A provides a view of a meter socket box 20 that includes a watt-hour meter 30, and FIG. 1B provides a view of a meter socket 40 located within meter socket box 20. Some portions of meter socket 40 (e.g., those portions that are unrelated to implementations described herein) are not shown.

Referring collectively to FIGS. 1A and 1B, meter socket 40 may be located within meter socket box 20. Meter socket box 20 may include openings in side and/or end walls for receiving line cables 22 and load cables 24. Line cables 22 and load cables 24 are shown in FIG. 1A for simplicity. In some installations, line cables 22 and load cables 24 may be included within conduits and/or enter/exit in the back of meter socket box 20. In one implementation, meter socket 40 may be mounted to a panel attached to the back wall of meter socket box 20. Meter socket box 20 may include a removable front cover 26 or door with an opening 28 for receiving the dome portion of meter 30, which extends through opening 28 when installed in meter socket 40.

Meter 30 may be coupled to a plurality of bus members or lines at meter socket 40. Meter 30 typically includes a cylindrically-shaped enclosure containing a metering device with the meter display on the front side and a plurality of blade connectors (not shown) extending from the back side. The blade connectors may be adapted to be received by jaw-type terminals in meter socket 40 to electrically connect the line and load buses (e.g., associated with line cables 22 or load cables 24) through meter 30.

Meter socket 40 may include a non-conductive base 42, line connectors 46, fasteners 48, conductive plates 50-1 through 50-4 (referred to herein collectively as "conductive plates 50" or generically as "conductive plate 50"), and/or bus bars. In one implementation, each of conductive plates 50 may be integral with one or more terminals (e.g., terminal 51, FIG. 2) to receive blade contacts (not shown) of meter 30.

Connector 46 may include, for example, a conventional power line fitting, such as a solderless-type lug that may use retaining screws to clamp a conductive lead (e.g., from line cables 22 or load cables 24) within connector 46. Connector 46 may be provided in different configurations and sizes (e.g., different physical dimensions). For example, connector 46 may include a single-line connector (as shown in FIG. 1B) or a double-line connector (as shown in FIG. 6B) depending on a particular application of meter socket 40. In implementations described herein, connector 46 may include a single mounting aperture to receive a fastener (e.g., fastener 48) for mounting. Each of connectors 46 may be attached to non-conductive base 42 and one of the conductive plates 50.

As shown in FIG. 1B, fasteners 48 may be used to secure connectors 46 to the conductive plates 50 of the load side of meter socket 40 (e.g., conductive plates 50-1 and 50-2 associated with load cables 24). Although not shown in FIG. 1B, connectors 46 may also be secured to the conductive plates 50 of the line side of meter socket 40 (e.g., conductive plates 50-3 and 50-4 associated with line cables 22). Thus, wires from line cables 22 or load cables 24 may be in electrical communication with terminals that receive blade contacts for meter 30.

Connectors 46 may carry high voltage and, thus, proper spacing/alignment of each connector 46 with other components of meter socket 40 is important to prevent arcing. To prevent loss of proper spacing due to rotation of connector 46 (e.g., around fastener 48), an anti-turn arrangement may be provided. In implementations described herein, conductive plate 50 may include an anti-turn protrusion 100 configured to accommodate different-sized connectors 46. Anti-turn protrusion 100 may include, for example, an embossment or separate material applied to conductive plate 50. Anti-turn protrusion 100 may allow conductive plate 50 to receive different sizes of connectors 46 so that different connectors can be changed in the field without requiring a change to conductive plate 50 (or a bus bar). As described further herein, anti-turn protrusion 100 may be formed to engage two surfaces of connector 46, in different sizes, to provide a better anti-turn restraint than, for example, a single-side engagement. Although described herein primarily in the context of conductive plate 50, in other implementations, anti-turn protrusion 100 may be applied to another conductive member, such as a bus bar, a bracket, etc. In other implementations, anti-turn protrusion 100 may be used in other contexts (e.g., other than a meter socket) to align different sizes of a lug or another device connected to a base.

Figure 2:
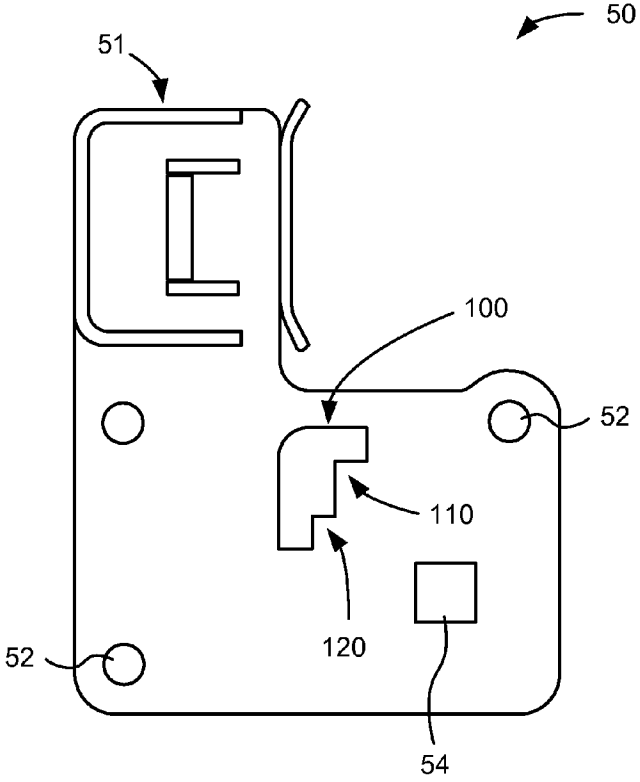
FIG. 2 provides a top view of a conductor plate with an anti-turn protrusion according to an implementation described herein.
Figure 3:
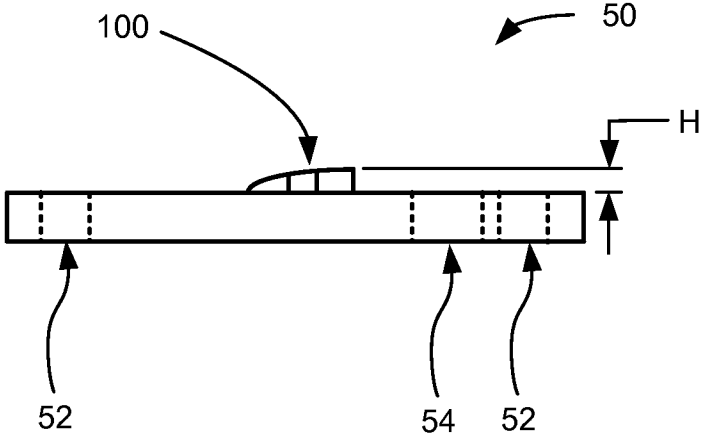
FIG. 3 provides a side view of the conductor plate of FIG. 2.
Figure 4:
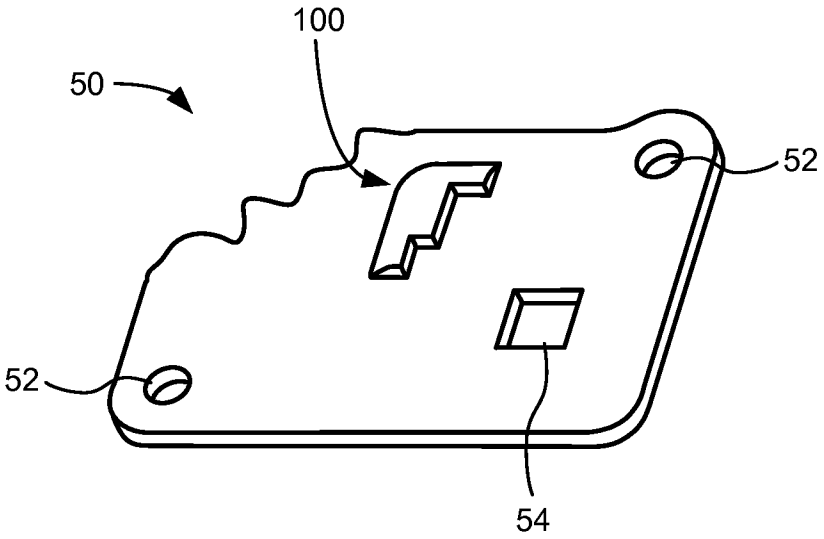
FIG. 4 provides an isometric view of the conductor plate of FIG. 2.
Figure 5:
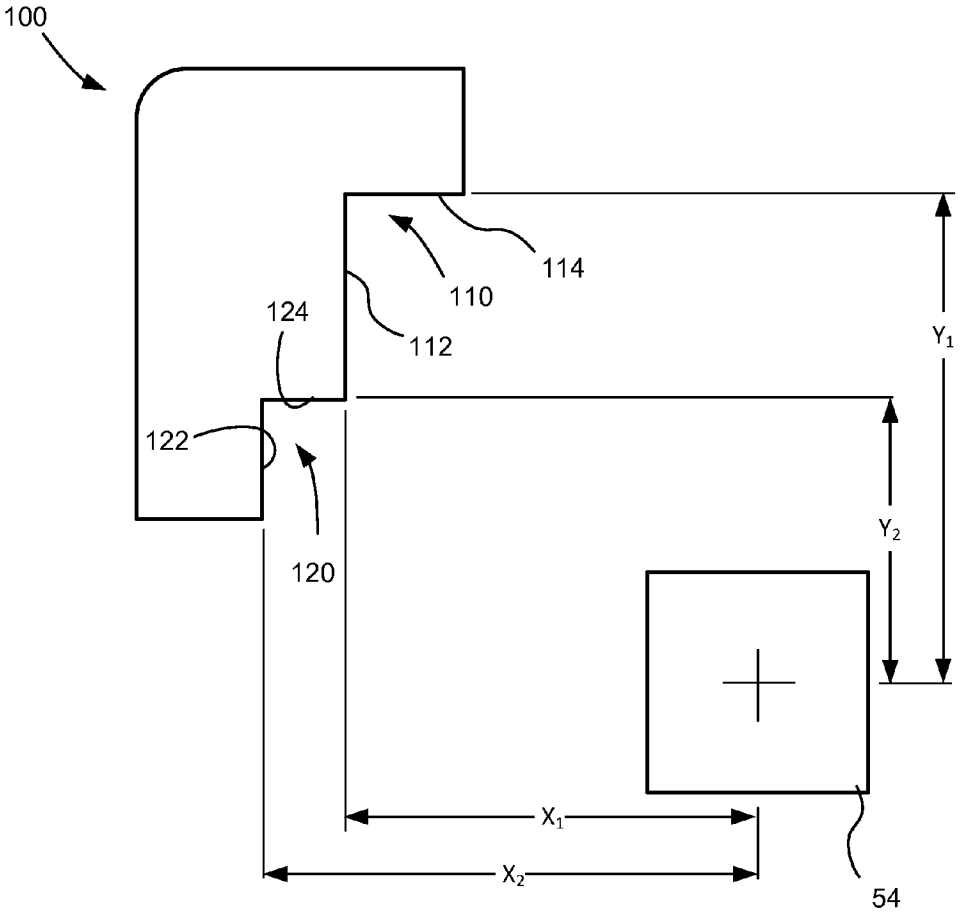
FIG. 5 provides an enlarged top view of a portion of the conductor plate of FIG. 2.

FIGS. 2-4 provide a top view, a front view, and an isometric view, respectively, of conductor plate 50 with anti-turn protrusion 100 according to an implementation described herein. FIG. 5 provides an enlarged top view of a portion of conductor plate 50. Referring collectively to FIGS. 2-5, conductor plates 50 may include apertures 52, an aperture 54, and anti-turn protrusion 100. Apertures 52 may generally be sized and positioned to receive mounting screws (e.g. to secure conductor plates 50 to non-conductive base 42). Aperture 54 may be sized to receive fastener 48 (e.g., to secure connector 46 to conductive plate 50).

Anti-turn protrusion 100 may include a pair of internal notches 110 and 120 to receive different sizes of connector 46. Anti-turn protrusion 100 may be positioned at a distance from the center of aperture 54 to permit notch 110 and notch 120 to engage with a corner of a connector 46 when connector 46 is installed at aperture 54. Each notch 110 and 120 may include a top edge and a side edge having sufficient length to engage two surfaces of a connector 46. More particularly, notch 110 may include a side edge 112 and a top edge 114, and notch 120 may include a side edge 122 and a top edge 124. The length of side edge 112, top edge 114, side edge 122, and top edge 124 may all be longer than a radius of a rounded corner of connector 46 that may be received in notch 110 or notch 120.

As best shown in FIG. 3, anti-turn protrusion 100 extends into a different plane than that of aperture 54. More particularly, anti-turn protrusion 100 may extend to a height, H, above the plane defined by the rest of conductive plate 50 around aperture 54. Although shown as a sloped surface rising to height H, in other implementations, anti-turn protrusion 100 may have a constant height. The height, H, of anti-turn protrusion 100 may vary depending upon the particular application, such as the size of the connectors used in meter socket 40. Generally, the height, H, may be configured to create a sufficient surface area along side edge 112, top edge 114, side edge 122, and top edge 124 to engage surfaces of connector 46 to prevent rotation of connector 46 around fastener 48.

As shown in FIG. 5, anti-turn protrusion 100 may be positioned with respect to aperture 54 such that side edge 112 of notch 110 is a particular distance $X_1$ from the center of aperture 54 and top edge 114 is a particular distance $Y_1$ from the center of aperture 54. The distance $X_1$ may correspond to, for example, the half-width of connector 46 when connector 46 is a standard single-line connector (e.g., with an aperture to receive fastener 48 centered along a width of connector 46). The distance $Y_1$ may correspond to, for example, the length from the center of an aperture to receive fastener 48 to a leading edge of connector 46 when connector 46 is a standard single-line connector.

Still referring to FIG. 5, anti-turn protrusion 100 may also be positioned with respect to aperture 54 such that side edge 122 of notch 120 is a particular distance $X_2$ from the center of aperture 54 and top edge 124 is a particular distance $Y_2$ from the center of aperture 54. The distance $X_2$ may correspond to, for example, the half-width of connector 46 when connector 46 is a standard double-line connector (e.g., with an aperture to receive fastener 48 centered along a width of connector 46). The distance $Y_2$ may correspond to, for example, the length from the center of an aperture to receive fastener 48 to a leading edge of connector 46 when connector 46 is a standard double-line connector.

In one implementation, anti-turn protrusion 100 may be formed as an integral part of conductive plate 50. For example, anti-turn protrusion 100 may be molded or cast as a single piece with conductive plate 50. In another implementation, anti-turn protrusion 100 may be formed via a punching process. In still other implementations, anti-turn protrusion 100 may be formed as a separate piece and attached to a base (e.g., conductive plate 50). For example, anti-turn protrusion 100 may be attached to conductive plate 50 using a welding process or mechanical fasteners. If formed as a separate piece, anti-turn protrusion 100 may be formed of the same or a different material than conductive plate 50.

Figure 6A:
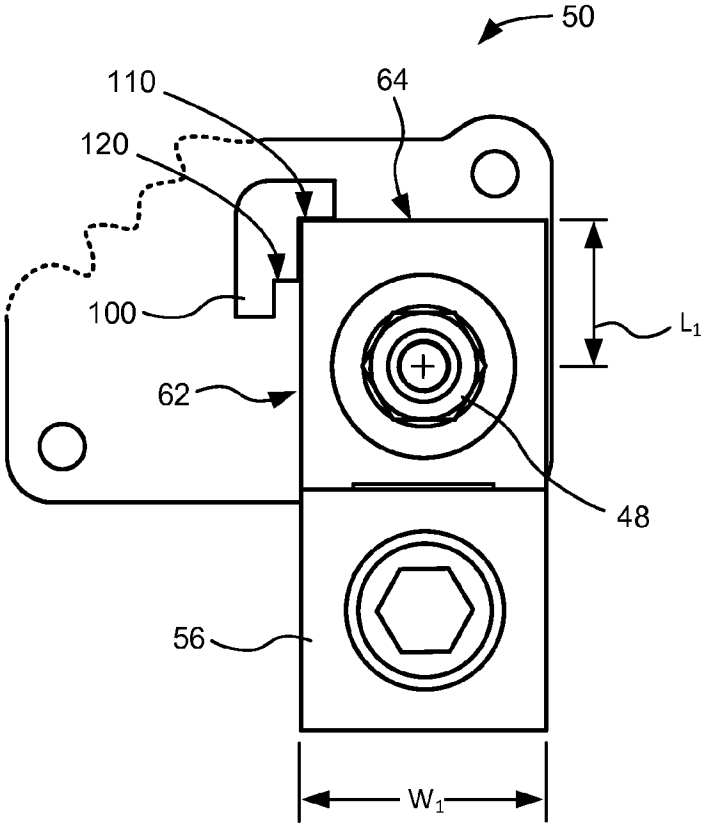
FIG. 6A provides a top view of the conductor plate of FIG. 2 with a single-line connector installed.
Figure 6B:
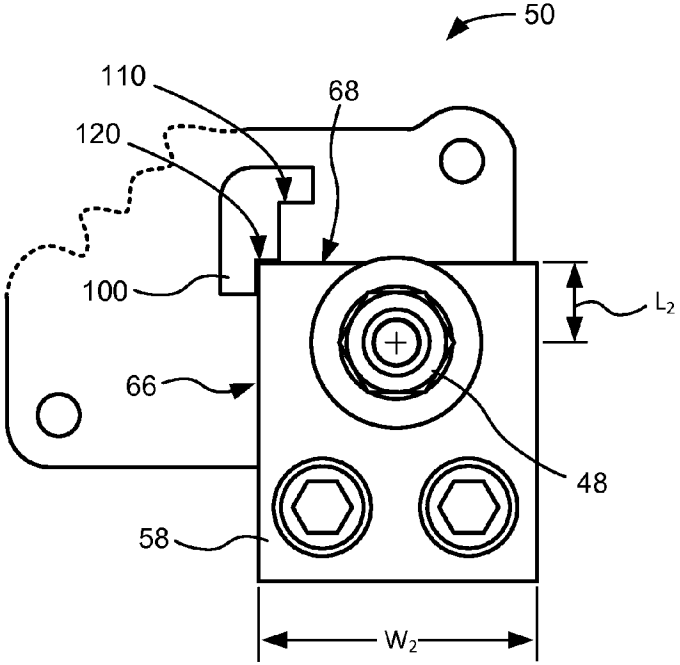
FIG. 6B provides a top view of the conductor plate of FIG. 2 with a double-line connector installed.

FIGS. 6A and 6B provide top views of different-sized connectors installed on conductive plate 50. Connectors in FIGS. 6A and 6B may correspond to different-sized connectors 46 described above. FIG. 6A provides a top view of anti-turn protrusion 100 receiving a single-line connector 56. FIG. 6B provides a top view of anti-turn protrusion 100 receiving a double-line connector 58.

Referring to FIG. 6A, a corner of single-line connector 56 may engage with notch 110 of anti-turn protrusion 100 so that single-line connector 56 is constrained from rotation (e.g., about fastener 48) along two surfaces, a side 62 and a side 64. Single-line connector 56 may include a width, $W_1$, as shown in FIG. 6A. Width $W_1$ may correspond to twice the distance of $X_1$ (FIG. 5) between the center of aperture 54 and side edge 112 of anti-turn protrusion 100. Single-line connector 56 may also include a length, $L_1$, between side 64 and the center of the aperture in single-line connector 56 that accepts fastener 48, as shown in FIG. 6A. Length $L_1$ may correspond to the distance $Y_1$ (FIG. 5) between the center of aperture 54 and top edge 114 in notch 110 of anti-turn protrusion 100. Notch 120 may not be used in installation of single-line connector 56.

Referring to FIG. 6B, a corner of double-line connector 58 may engage with notch 120 of anti-turn protrusion 100 so that double-line connector 58 is constrained from rotation (e.g., about fastener 48) along two surfaces, a side 66 and a side 68. Double-line connector 58 may include a width, $W_2$, as shown in FIG. 6B. Width $W_2$ may correspond to twice the distance of $X_2$ (FIG. 5) between the center of aperture 54 and side edge 122 of anti-turn protrusion 100. Double-line connector 58 may also include a length, $L_2$, between side 68 and the center of the aperture in double-line connector 58 that accepts fastener 48, as shown in FIG. 6B. Length $L_2$ may correspond to the distance $Y_2$ (FIG. 5) between the center of aperture 54 and top edge 124 in notch 120 of anti-turn protrusion 100. Notch 110 may not be used in installation of double-line connector 58.

Figure 7:
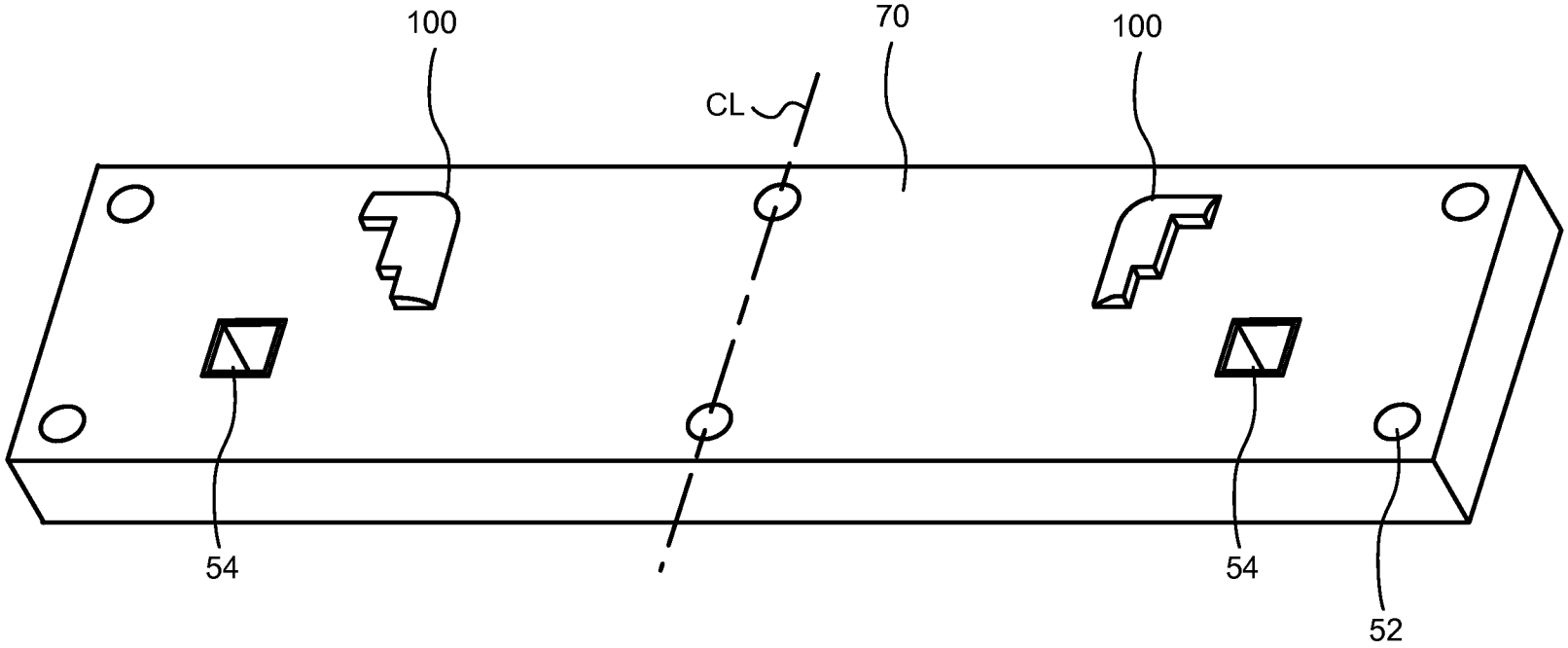
FIG. 7 provides an isometric view of an anti-turn mechanism applied to a bus bar according to another implementation.

FIG. 7 provides an isometric view of two anti-turn protrusions 100 applied directly to a bus bar 70. Each anti-turn protrusion 100 and aperture 54 may have features described above in connection with any of FIGS. 1B-6B. As shown in FIG. 7, anti-turn protrusions 100 and their respective apertures 54 may be configured as mirror images about a centerline (CL) of bus bar 70. Thus, each anti-turn protrusion 100 (e.g., on different sides of the centerline CL) may engage with a different upper corner of an installed connector 46. In other configurations, anti-turn protrusions 100 may be arranged to accept the same corner of an installed connector or may be arranged with no particular symmetry between each other.

Figure 8:
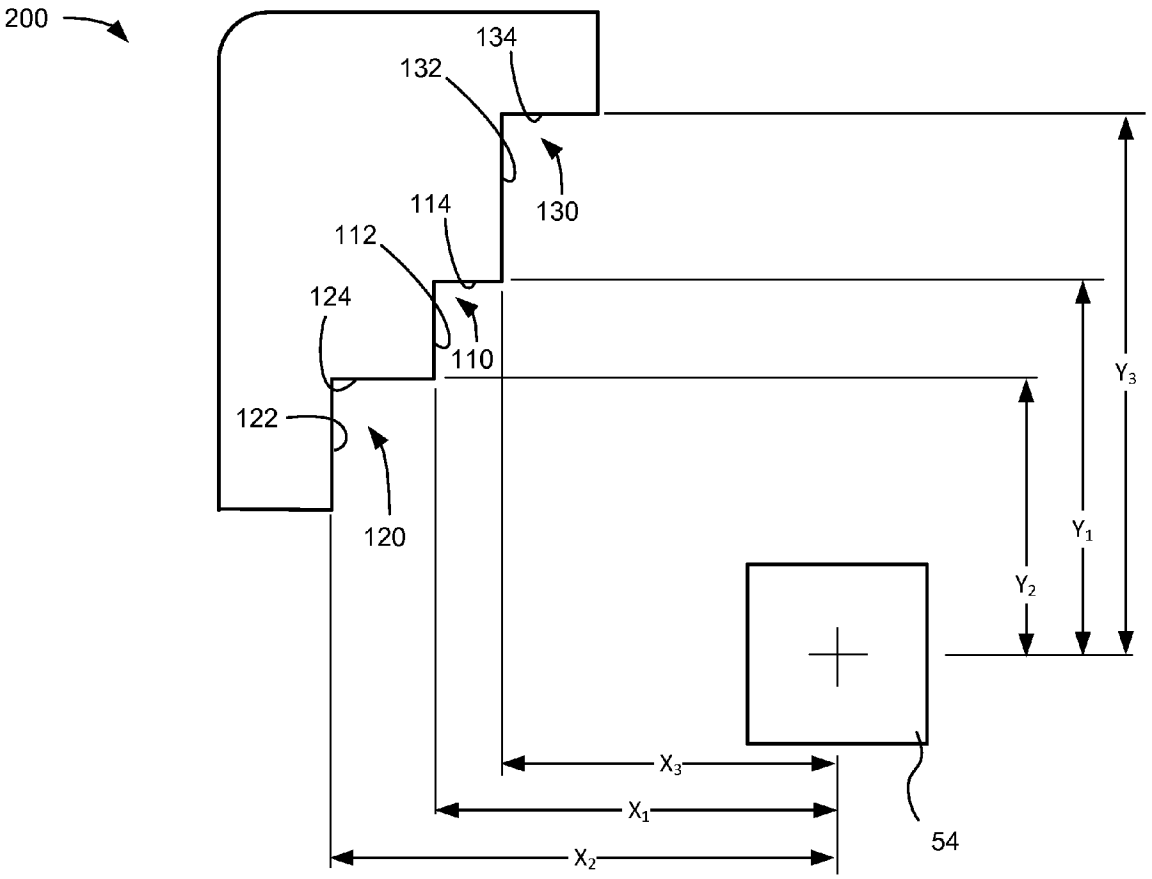
FIG. 8 provides an enlarged top view of an anti-turn protrusion according to another implementation.

FIG. 8 provides an enlarged view of an anti-turn protrusion 200 according to another implementation. Anti-turn protrusion 200 may be configured to accommodate three different sizes of connectors 46. Anti-turn protrusion 200 may include notch 110, notch 120, and a notch 130. Similar to anti-turn protrusion 100, notches 110 and 120 of anti-turn protrusion 200 may be positioned with respect to aperture 54 such that notch 110 may receive a corner of a first size connector 46 (such as single-line connector 56) and notch 120 may receive a corner of a second sized connector 46 (such as double-line connector 58).

Still referring to FIG. 8, anti-turn protrusion 200 may be positioned with respect to aperture 54 such that a side edge 132 of notch 130 is a particular distance $X_3$ from the center of aperture 54 and top edge 134 of notch 130 is a particular distance $Y_3$ from the center of aperture 54. The distance $X_3$ may correspond to, for example, the half-width of connector 46 when connector 46 is a non-standard single-line connector (e.g., with an aperture to receive fastener 48 centered along a width of connector 46). The distance $Y_3$ may correspond to, for example, the length from the center of an aperture to receive fastener 48 to a leading edge of connector 46 when connector 46 is a non-standard single-line connector. In other implementations, anti-turn protrusion 200 may be configured to receive additional and/or differently-sized connectors.

In implementations described herein, a conductive member for receiving a line connector is provided. The conductive member may include an aperture configured to receive a fastener for the line connector and a protrusion in a different plane than that of the aperture. The protrusion may include notches configured to receive different-sized line connectors (e.g., when the line connectors are secured to the conductive member by the fastener through the aperture). Each of the two or more notches may be configured to engage two surfaces of a line connector to prevent rotation of the line connector about the fastener.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. For example, although notches 110, 120, and 130 are shown having essentially right angles to receive corners of connectors 46, in other embodiments, differently-shaped notches may be used to receive differently-shaped connectors 46. Additionally, although described herein primarily in the context of a meter socket connection, one or more anti-turn protrusions 100 may be applied in other contexts to provide alignment and versatility for attaching other types of lugs/devices to a base structure. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A conductive member for receiving a line connector, the conductive member comprising:

an aperture, in a first plane, configured to receive a fastener for the line connector; and a protrusion, in a second plane that is different than the first plane, including two or more notches, wherein each of the two or more notches is configured to receive a different-sized line connector secured to the conductive member by the fastener through the aperture, and wherein each of the two or more notches is configured to engage two surfaces of one of the different-sized line connectors to prevent rotation of the one of the different-sized line connectors.

2. The conductive member of claim 1, wherein the protrusion is configured to receive a single-line connector in one of the two or more notches and a double-line connector in another of the two or more notches.

3. The conductive member of claim 1, wherein the protrusion includes a height at each of the two or more notches to create a surface area that engages the two surfaces of the one of the different-sized line connectors to prevent rotation around the fastener.

4. The conductive member of claim 1, wherein the protrusion is formed onto the conductive member via one or more of:

stamping, molding, mechanical fastening, or welding.

5. The conductive member of claim 1, further comprising:

one or more additional apertures to receive mounting screws to secure the conductive member to a base of a meter socket.

6. The conductive member of claim 1, wherein the conductive member is a bus bar further comprising:

another aperture, in the first plane, configured to receive another fastener for a different line connector; and another protrusion, in the second plane, the other protrusion including two or more other notches, wherein each of the two or more other notches is configured to receive the different-sized line connector secured to the conductive member by the fastener through the other aperture.

7. The conductive member of claim 1, further comprising:

a terminal configured to receive a blade contact of a meter for a meter socket.

8. An anti-turn assembly, comprising:

an aperture, in a first plane, configured to receive a fastener for securing a connector to a base; and a protrusion, in a second plane that is different than the first plane, the protrusion being configured to receive, at different times, a first-size connector secured by the fastener through the aperture and a second-size connector secured by the fastener through the aperture, wherein the protrusion is further configured to engage the first-size connector and the second-size connector on at least two surfaces of the first-size connector or the second-size connector so as to prevent rotation of the first-size connector or the second-size connector about the fastener.

9. The anti-turn assembly of claim 8, wherein the protrusion further comprises:

a first notch configured to receive a corner of the first-size connector, and a second notch configured to receive a corner of the second-size connector.

10. The anti-turn assembly of claim 8, wherein the first-size connector is a single-line connector for a meter socket and wherein the second-size connector is a double-line connector for the meter socket.

11. The anti-turn assembly of claim 8, wherein the protrusion is further configured to receive a third-size connector secured by the fastener through the aperture, wherein the protrusion is further configured to engage the third-size connector on at least two surfaces of the third-size connector so as to prevent rotation of the third-size connector about the fastener.

12. The anti-turn assembly of claim 8, wherein the aperture and the protrusion are included on a bus bar.

13. The anti-turn assembly of claim 8, wherein the aperture and the protrusion are included on a conductive plate that further comprises a terminal to receive a blade contact of a meter for a meter socket.

14. A conductive member for mounting a meter socket line connector, the conductive member comprising:

an aperture, in a first plane, configured to receive a fastener for the line connector; and a protrusion, in a second plane that is different than the first plane, including:

a first notch configured to receive a first-size line connector secured to the conductive member by the fastener through the aperture, a second notch configured to receive a second-size line connector secured to the conductive member by the fastener through the aperture, wherein, the protrusion is configured to receive a corner of either the first-size line connector or the second-size line connector without changes to the conductive member.

15. The conductive member of claim 14, wherein the first notch is configured to engage two surfaces of the first-size line connector to prevent rotation of the first-size line connector around the fastener, and wherein the second notch is configured to engage two surfaces of the second-size line connector to prevent rotation of the second-size line connector around the fastener.

16. The conductive member of claim 14, wherein the first-size line connector is a single-line connector for a meter socket, and wherein the second-size line connector is a double-line connector for the meter socket.

17. The conductive member of claim 14, wherein the protrusion further comprises:

a third notch configured to receive a third-size line connector secured to the conductive member by the fastener through the aperture, wherein, the protrusion is configured to receive a corner of the first-size line connector, a corner of the second-size line connector, or a corner of the third-size line connector without changes to the conductive member.

18. The conductive member of claim 14, further comprising:

a terminal configured to receive a blade contact of a meter for a meter socket.

19. The conductive member of claim 14, wherein the protrusion is configured to receive a single-line connector in one of the first notch and a double-line connector in the second notch.

20. The conductive member of claim 14, wherein the conductive member is a bus bar for a meter socket.

* * * * *